US009145150B2

(12) United States Patent
Vande Sande

(10) Patent No.: US 9,145,150 B2
(45) Date of Patent: Sep. 29, 2015

(54) RAILCAR COVER

(71) Applicant: Jerry W. Vande Sande, Dallas, TX (US)

(72) Inventor: Jerry W. Vande Sande, Dallas, TX (US)

(73) Assignee: Trinity Industries, Inc., Dallas, TX (US)

( * ) Notice: Subject to any disclaimer, the term of this patent is extended or adjusted under 35 U.S.C. 154(b) by 163 days.

(21) Appl. No.: 13/895,718

(22) Filed: May 16, 2013

(65) Prior Publication Data

US 2014/0013994 A1 Jan. 16, 2014

Related U.S. Application Data

(60) Provisional application No. 61/648,993, filed on May 18, 2012.

(51) Int. Cl.
*B61D 39/00* (2006.01)

(52) U.S. Cl.
CPC ..... *B61D 39/001* (2013.01); *B61D 39/002* (2013.01)

(58) Field of Classification Search
CPC ..... B61D 39/00; B61D 39/001–39/003; B61D 39/005; B61D 39/006
USPC ..... 105/377.01–377.06
See application file for complete search history.

(56) References Cited

U.S. PATENT DOCUMENTS

| | | | | |
|---|---|---|---|---|
| 3,169,492 | A * | 2/1965 | Stiefel et al. | 105/377.05 |
| 4,627,658 | A * | 12/1986 | Vold et al. | 296/100.1 |
| 5,076,174 | A * | 12/1991 | Martin | 105/377.03 |
| 8,256,355 | B2 * | 9/2012 | Dial et al. | 105/377.05 |

* cited by examiner

*Primary Examiner* — R. J. McCarry, Jr.
(74) *Attorney, Agent, or Firm* — Baker Botts L.L.P.

(57) ABSTRACT

A system for covering a railcar includes a first set and a second set of structural members coupled to a railcar. The structural members are configured to move between a loading position, an unloading positing, and a covered position. The system includes a plurality of cover portions, each coupled to a structural member of the first set and a structural member of the second set. In the loading position, at least one of the first set and at least one of second set are proximate longitudinal sides of the railcar. In the unloading position, at least one of the first set and at least one of second set are proximate a longitudinal center line of the railcar. In the covered position, the first set are proximate the longitudinal center line of the railcar, and the second set are proximate the longitudinal sides of the railcar.

17 Claims, 16 Drawing Sheets

RAILCAR COVER

RELATED APPLICATION

This application claims priority from U.S. Provisional Application No. 61/648,993, filed May 18, 2012, entitled Railcar Cover.

TECHNICAL FIELD

The present disclosure is related to railroad freight cars, and more particularly to systems and methods for covering a railroad freight car, such as a coal-carrying railcar.

BACKGROUND

Uncovered railcars, particularly uncovered railcars transporting coal, present environmental and rail maintenance challenges. Communities with near-rail residential, agricultural, educational, or professional centers often have concerns about the health and environmental impact of coal dust. Additionally, companies operating railways face maintenance problems and rail bed damage caused by coal dust.

Existing covers include fiberglass models that are heavy and may prove cumbersome to use during loading and unloading. Other methods to control coal dust include the application of a dusting agent to loaded coal and grooming loaded coal. However, neither method may realize the containment targets set or desired by operating companies and near-rail communities.

SUMMARY

The teachings of the present disclosure relate to a system and a method for covering a railcar. In accordance with one embodiment, a system for covering a railcar includes a first set of structural members coupled to a railcar and a second set of structural members coupled to the railcar. The first set and second set of structural members are configured to move between a loading position, an unloading positing, and a covered position. The system includes a plurality of cover portions. Each cover portion of the plurality of cover portions is coupled to a structural member of the first set of structural members and a structural member of the second set of structural members. In the loading position, at least one of the first set and at least one of second set of structural members are proximate longitudinal sides of the railcar. In the unloading position, at least one of the first set and at least one of second set of structural members are proximate a longitudinal center line of the railcar. In the covered position, the first set of structural members are proximate the longitudinal center line of the railcar, and the second set of structural members are proximate the longitudinal sides of the railcar.

In accordance with another embodiment, a method for opening a railcar cover includes moving, between a covered position and a loading position, a first set of structural members coupled to a railcar and a second set of structural members coupled to the railcar. The railcar cover comprises a plurality of cover portions. Each cover portion of the plurality of cover portions is coupled to a structural member of the first set of structural members and a structural member of the second set of structural members. In the loading position, at least one of the first set and at least one of second set of structural members are proximate longitudinal sides of the railcar. In the covered position, the first set of structural members are proximate a longitudinal center line of the railcar, and the second set of structural members are proximate the longitudinal sides of the railcar.

Technical advantages of particular embodiments may include providing a railcar cover effective at containing dust from coal and other materials transported by rail. Another technical advantage of particular embodiments is the reduced weight of the railcar cover in comparison to conventional covers. The reduced weight of the cover may allow a rail operator to increase the weight of the railcar cargo. An additional technical advantage of various embodiments is the ability of the cover to open into at least two unique positions, thereby providing an open position suitable for loading by a machine such as a coal tipple as well as an open position suitable for unloading by a machine such as a rotary dumper. Another technical advantage of certain embodiments is the improved aerodynamics of transporting loaded or unloaded railcars.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

A more complete understanding of particular embodiments will be apparent from the detailed description taken in conjunction with the accompanying drawings in which.

DETAILED DESCRIPTION

Figure 1A:
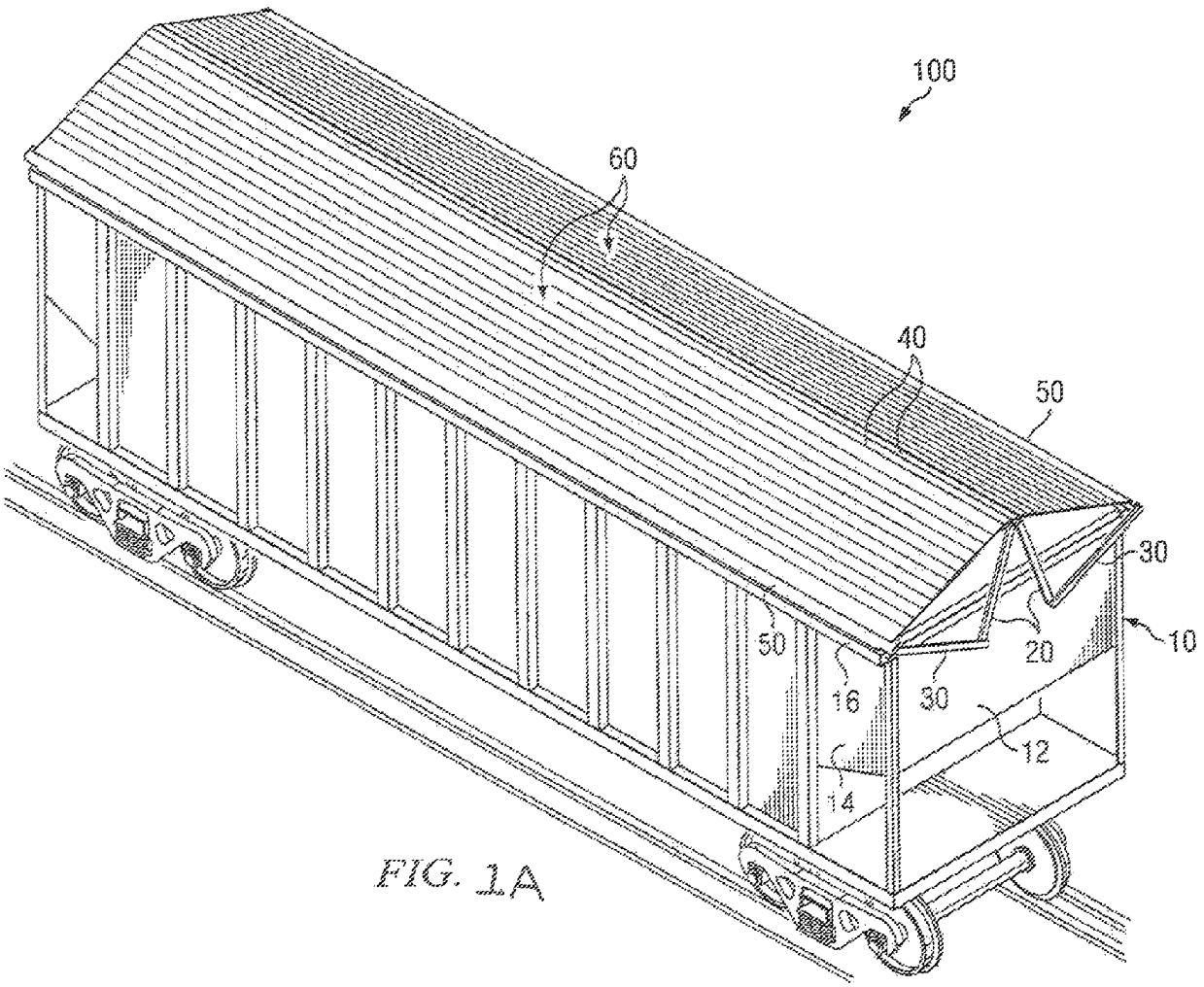
FIGS. 1A and 1B illustrate railcar cover systems in accordance with particular embodiments.
Figure 1B:
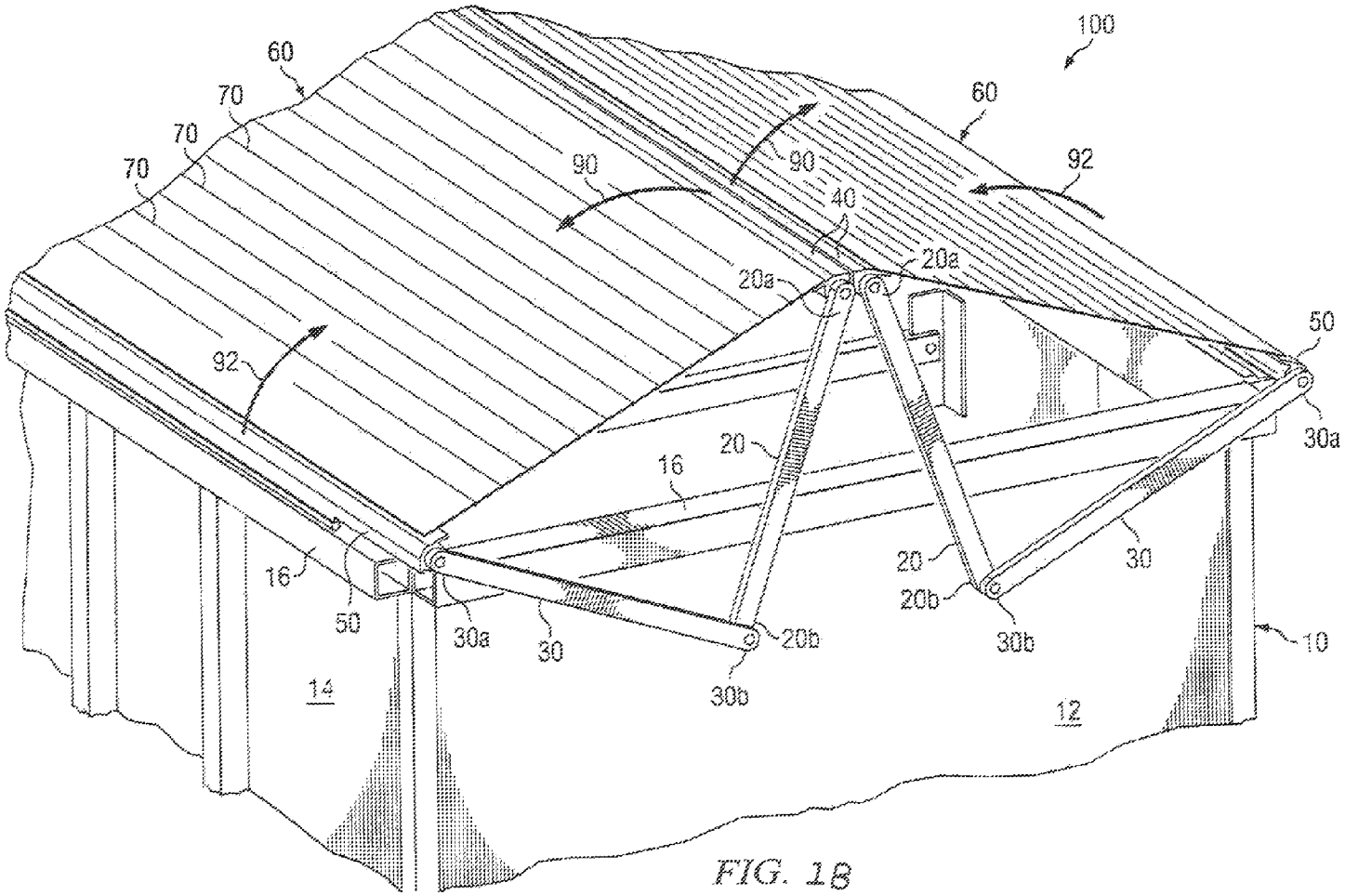

FIGS. 1A, 1B, 2, 3A, 3B, 3C, 3D, 3E, and 3F illustrate railcar cover systems in accordance with particular embodiments. FIG. 1A illustrates railcar cover system 100 comprising railcar 10, inner levers 20, outer levers 30, inner structural members 40, outer structural members 50, and cover portions 60. Railcar 10 comprises short sides 12, long sides 14, and top chord 16. FIG. 1B also illustrates these elements. In addition, FIG. 1B illustrates rod portions 70, inner lever ends 20*a* and 20*b*, and outer lever ends 30*a* and 30*b*. Also illustrated are directional arrows 90 and 92.

Two inner levers 20 and two outer levers 30 are located at each short side 12 of railcar 10. At inner lever end 20*a*, each inner lever 20 is coupled to an inner structural member 40. Inner structural members 40 extend in a plane generally perpendicular to inner levers 20 and run generally parallel to long sides 14 of railcar 10. At outer lever end 30*a*, each outer lever 30 is coupled to an outer structural member 50. Outer structural members 50 extend in a plane generally perpendicular to outer levers 30 and run generally parallel to long sides 14 of railcar 10.

Cover portions 60 are each coupled to one inner structural member 40 and one outer structural member 50 such that cover portions 60 may extend between the structural members to provide a canopy above railcar 10. Rod portions 70 assist cover portions 60 in retaining a desired shape when extended between the inner and outer structural members. In particular embodiments, a cover portion may comprise fabric, nylon, plastic, or any suitable material, or any combination of suitable materials. In certain embodiments, cover portions may or may not comprise rod portions. In various embodiments, inner and outer structural members may be as long, nearly as long, or longer than the railcar, or may be of any suitable length. Likewise, cover portions may be of any satisfactory length. Utilizing structural members and cover portions of varying lengths may allow the application of a railcar cover system to railcars of varying lengths.

Inner levers 20 and outer levers 30 pivot generally about ends 20*b* and 30*b* respectively. This allows each end 20*a* of inner levers 20 to move from the illustrated position above the railcar toward top chords 16 of long sides 14 in the respective directions of arrows 90. Pivoting also allows each end 30*a* of outer levers 30 to move from the illustrated position near top chords 16 of long sides 14 in the respective directions of arrows 92 toward the position generally above the railcar. In various embodiments, inner and outer levers may pivot about any suitable point.

Figure 2:
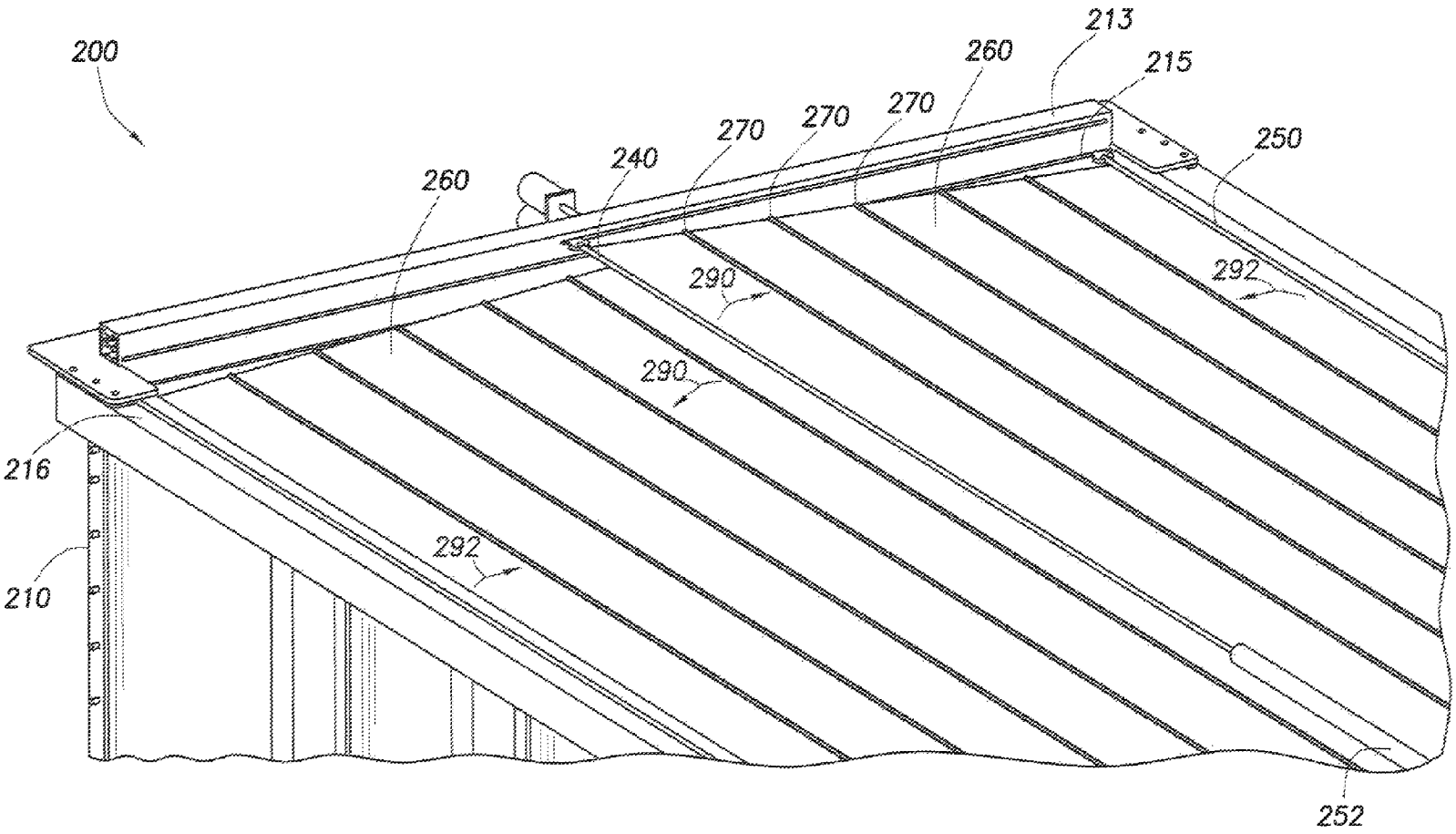
FIG. 2 illustrates a railcar cover system, in accordance with particular embodiments.

FIG. 2 illustrates railcar cover system 200 comprising railcar 210, insert 213 with tracks 215, top chord 216, inner structural members 240, outer structural members 250, rollers 252, cover portions 260, and rod portions 270. Also illustrated are directional arrows 290 and 292.

Insert 213 is coupled to railcar 210 near top chord 216. Insert 213 includes tracks 215 which allow for movement of various components of system 200. Insert 213 may be permanently coupled to railcar 210 or may be removable. In various embodiments, insert 213 may be added to existing railcars. Although not illustrated here, in certain embodiments, a second insert may be positioned at the opposite end of railcar 210. In various embodiments, an insert or inserts may be eliminated and components may be coupled directly to railcar 210.

Inner structural members 240 are positioned near the middle of railcar 210 and coupled to insert 213. Outer structural members 250 are positioned along the long side of railcar 210 and are also coupled to insert 213. In various embodiments, inner structural members 240 and outer structural members 250 may be cables, ropes or straps. As inner structural members 240 and outer structural members 250 extend from one insert 213 to the other, the members may be pulled taut. For example, in embodiments where inner and outer structural members 240 and 250 are cables, each cable may be drawn relatively tightly between the inserts, such that there is little or no slack in the cables.

Cover portions 260 are each coupled to one inner structural member 240 and one outer structural member 250 such that cover portions 260 may extend between the structural members to provide a canopy above railcar 10. In comparison to system 100, described in conjunction with FIGS. 1A and 1B, cover portions 260 in system 200 may create a flatter cover that includes less of an upward angle between outer structural members and inner structural members. Similar to system 100, cover portions 260 may comprise fabric, nylon, plastic, or any suitable material or materials to cover railcar 210. Rod portions 270 assist cover portions 260 in retaining a desired shape when extended between inner and outer structural members 240 and 250. In some embodiments, cover portions 260 may not include rod portions 270, or may include fewer rod portions than illustrated.

Inner structural members 240 and outer structural members 250 may move within railcar 210. For example, at the ends of inner structural members 240 and outer structural members 250, each are coupled to inserts 213 and at the point of coupling, the members may move along tracks 215. This may allow inner structural members 240 to move away from the center of railcar 210 in the direction of arrows 290 and/or may allow outer structural members 250 may move toward the center of railcar 210 in the direction of arrows 292.

In various embodiments, cover portions 260 may rest on coal being transported in railcar 210. Rollers 252 may be coupled to inner structural members 240 and/or outer structural members 250. As inner structural members 240 or outer structural members 250 move along tracks 215, rollers 252 may help system 200 roll over the underlying coal heap. In certain embodiments, there may be multiple rollers 252 along some or all of the system's structural members. Rollers 252 may be made from rubber, plastic, or any suitable material. In particular embodiments, cover portions 260 may be coupled to rollers 252 or cover portions 260 may be coupled to structural members outside the footprint of rollers 252.

System 200 may provide for a reduction in weight, which may correspond to improvements in various economic indicators for a railcar operator. System 200 may also provide various operational and environmental benefits, including, for example, preventing coal dust for leaving railcar 210 while maintaining a low-profile, aerodynamic profile.

Figure 3A:
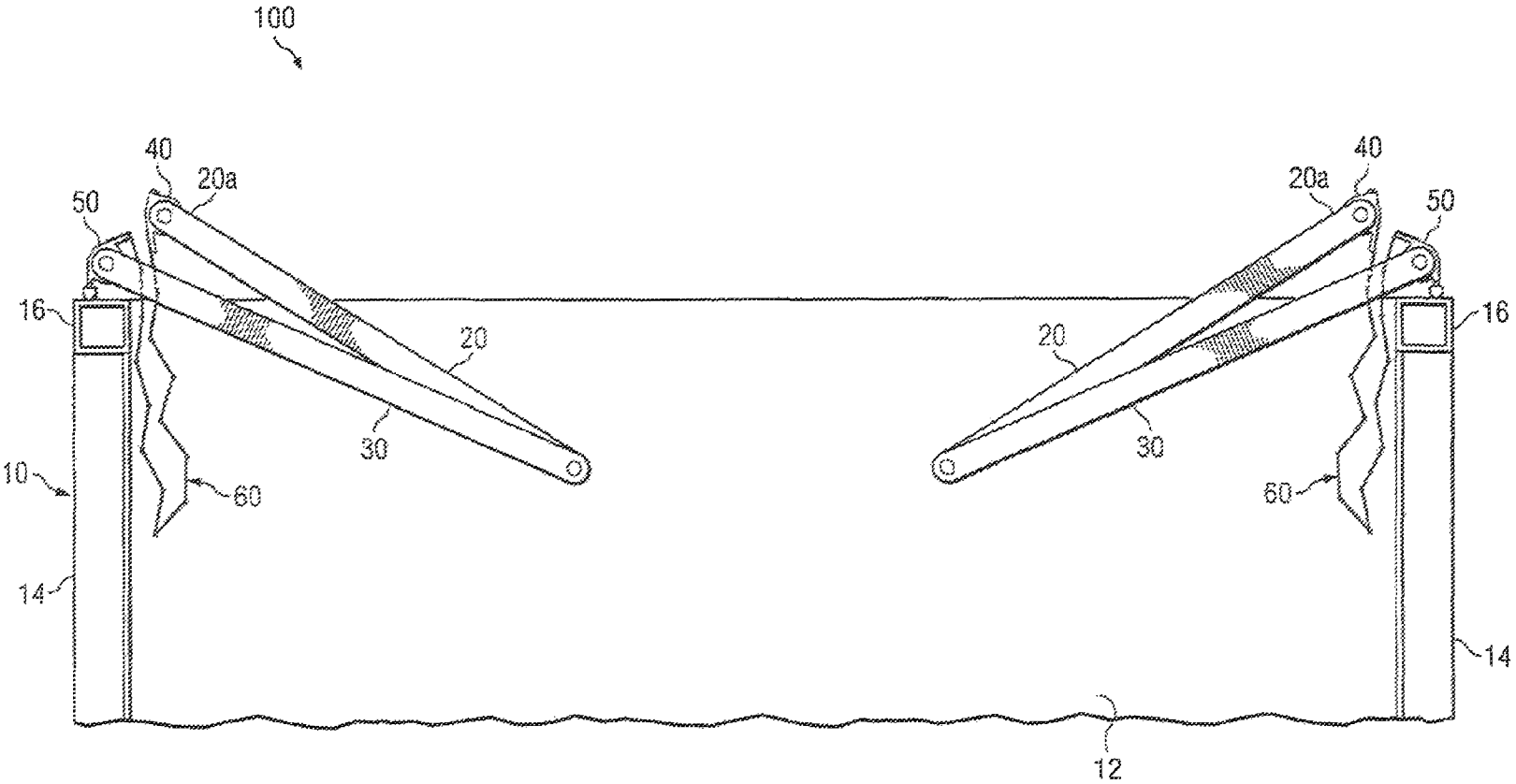
FIGS. 3A-3B illustrate a railcar cover system configured in an open position in accordance with particular embodiments.
Figure 3B:
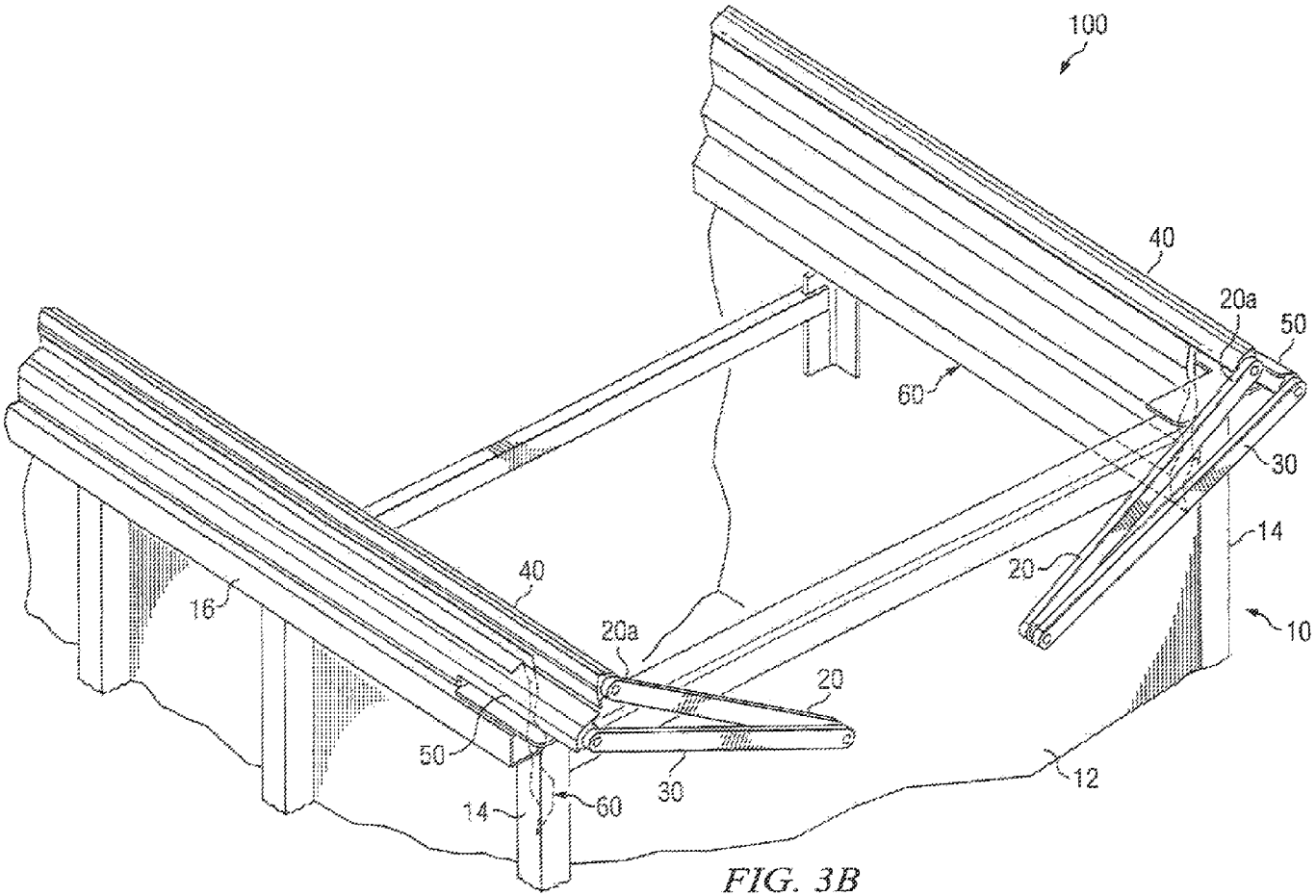

FIGS. 3A and 3B illustrate railcar cover system 100 configured in an open position in accordance with particular embodiments. From the closed position illustrated in FIGS. 1A and 1B, inner levers 20 pivot such that ends 20*a* move from above railcar 10 toward top chords 16 of long sides 14. As this movement occurs, cover portions 60 fold in on themselves, so as to open the railcar cover system. This positioning of inner levers 20 causes cover portions 60 to hang below inner structural members 40 and outer structural members 50 into railcar 10, generally below top chords 16 of long sides 14.

Positioning railcar cover system 100 in this manner allows the center portion of railcar 10 to remain open which may facilitate loading of coal, grain, or other material suitable for transport by railcar. For example, in particular embodiments used in conjunction with coal transport, a coal loading tipple dips down into a railcar to load the car with coal from above. Thus, the center portion of a railcar's interior must be free of obstruction during the loading process. Further, this positioning may allow the cover portions to reduce blow back that may occur during loading of the railcar. For example, in certain embodiments, cover portions may reduce coal dust blown up out of the railcar during coal loading from a coal loading tipple.

Figure 3C:
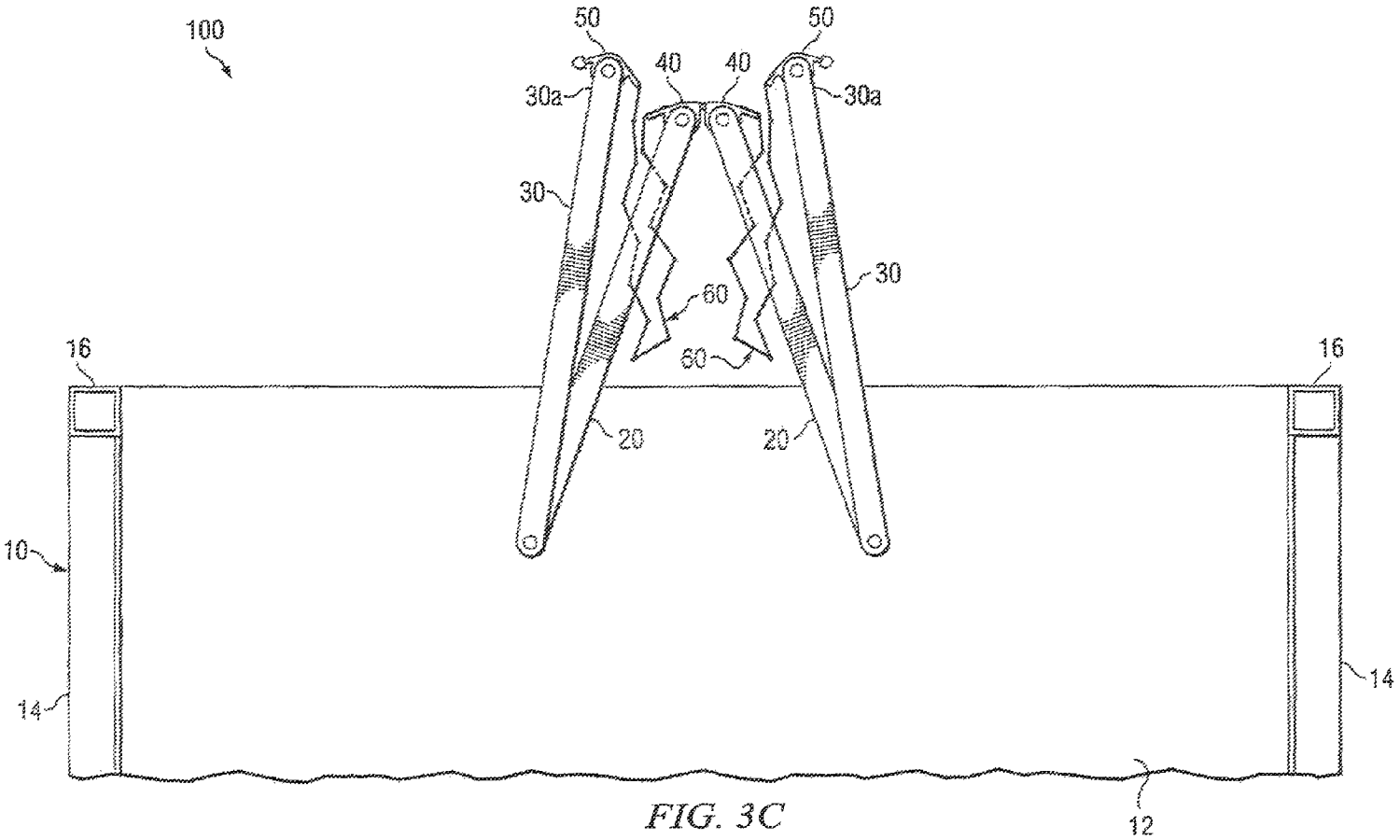
FIGS. 3C-3D illustrate a railcar cover system configured in an open position in accordance with particular embodiments.
Figure 3D:
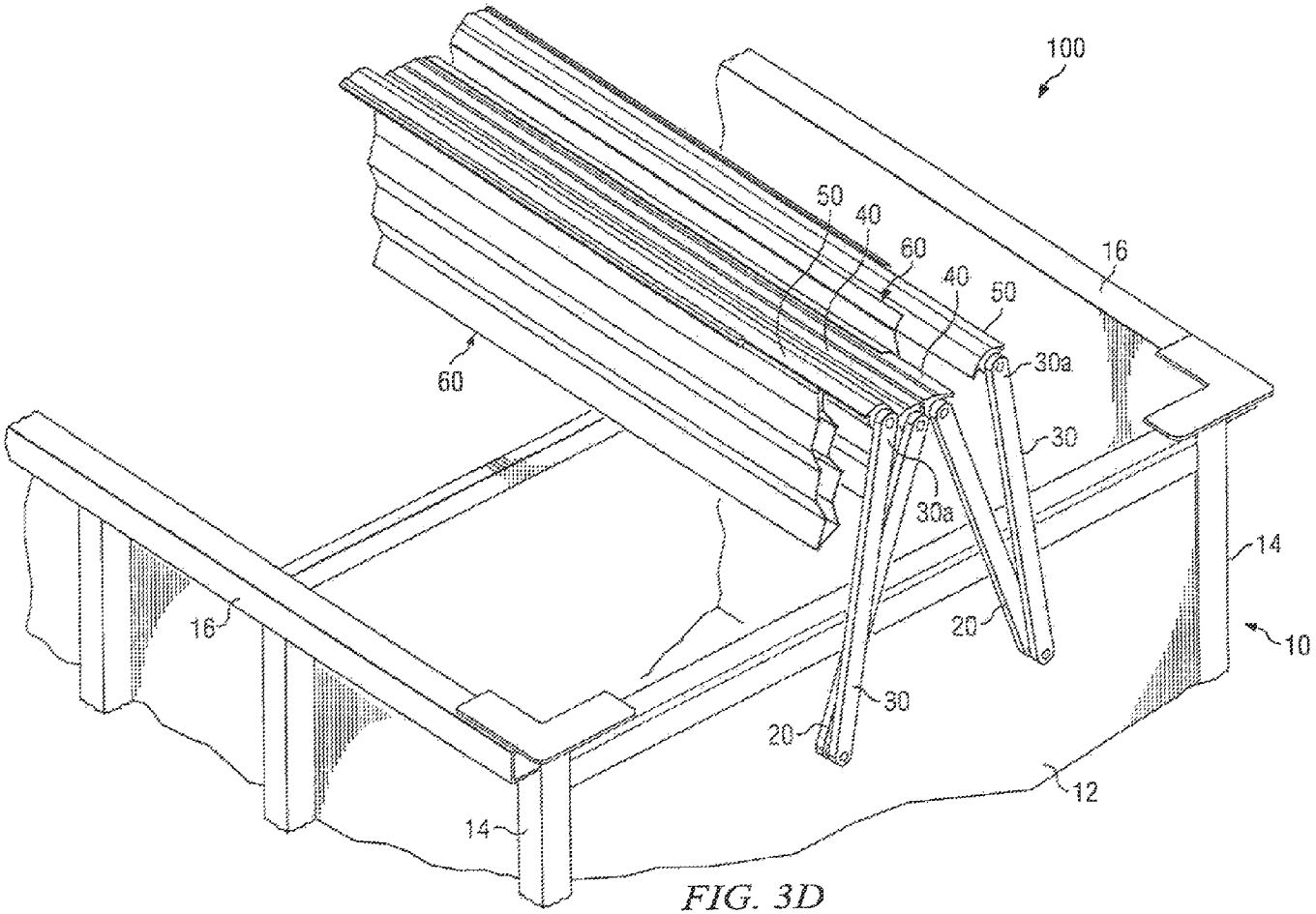

FIGS. 3C and 3D illustrate railcar cover system 100 configured in an open position in accordance with particular embodiments. From the closed position illustrated in FIGS. 1 and 2, outer levers 30 pivot such that ends 30*a* move from near top chords 16 of long sides 14 toward a position generally above the center of railcar 10. As this movement occurs, cover portions 60 fold in on themselves, so as to open the railcar cover system. This positioning of outer levers 30 causes cover portions 60 to hang below inner structural members 40 and outer structural members 50.

Positioning railcar cover system 10 in this manner allows the side portions of railcar 10 to remain unobstructed, which may facilitate loading and unloading of coal, grain, or other material suitable for transport by railcar as it allows the portions of railcar 10 along top chords 16 on long sides 14 to remain open and unobstructed. This positioning may improve the ease with which the railcar is unloaded. For example, in particular embodiments used in conjunction with coal transport, rotary dumping, as described previously, may be employed. Positioning railcar cover system 100 in an open configuration as illustrated in FIGS. 3*c* and 3*d* may allow coal to be unloaded by a rotary dumper or other mechanism that unloads coal by partially or fully overturning a railcar. In various embodiments, cover portions may not extend into the railcar or may extend to any suitable length in the railcar.

Figure 3E:
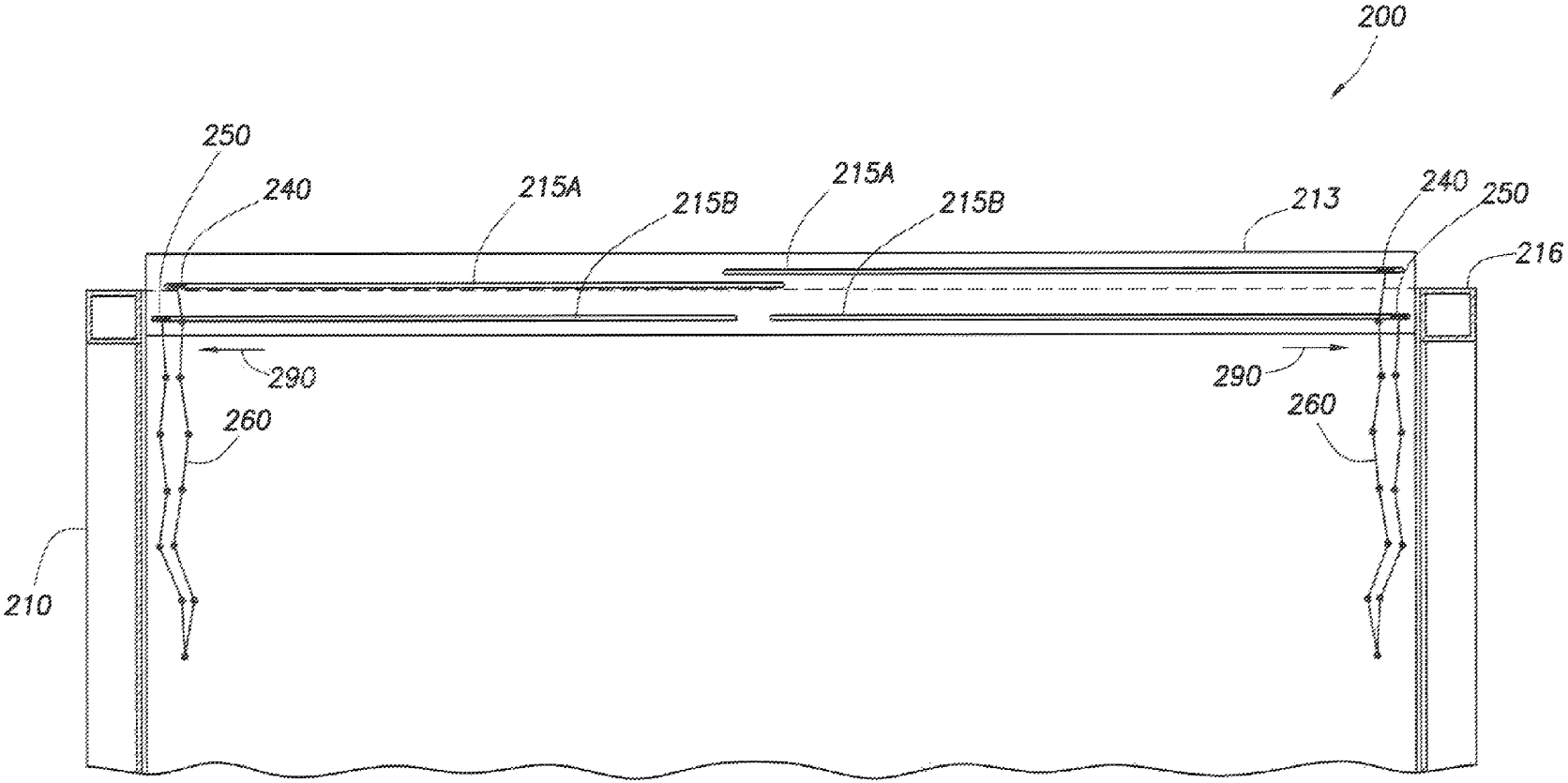
FIG. 3E illustrates a railcar cover system configured in an open position in accordance with particular embodiments.

FIG. 3E illustrates railcar cover system 200 configured in an open position in accordance with particular embodiments. From the closed position illustrated in FIG. 2, inner structural members 240 move along tracks 215*a* from the middle of railcar 210 toward top chords 216 in the direction of arrows 290. As this movement occurs, cover portions 216 fold in on themselves, so as to open the railcar cover system. This positioning of inner structural members 240 causes cover portions 260 to hang below inner structural members 240 and outer structural members 250 downward into railcar 210, generally below top chords 216.

Similar to the configuration described in conjunction with FIGS. 3A and 3B, positioning railcar cover system 200 in this manner, allows the center portion of railcar 216 to remain open, which may facilitate loading of the railcar for transport. For example, as described previously, clearing the middle of a railcar may better facilitate coal loading via a coal loading tipple. Positioning cover portions 260 at the sides of railcar 210 may also reduce blow back created by the loading process.

Figure 3F:
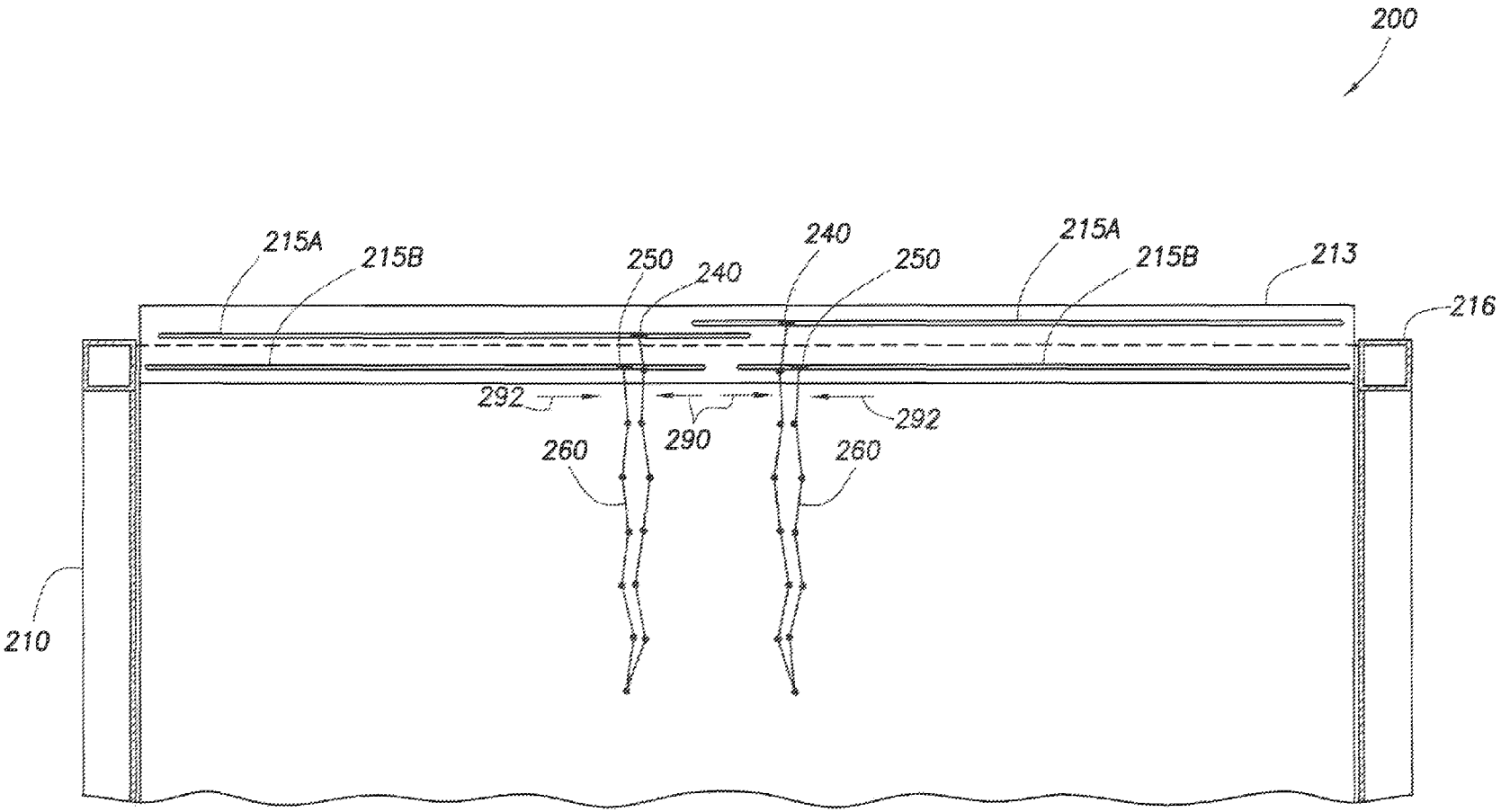
FIG. 3F illustrates a railcar cover system configured in an open position in accordance with particular embodiments.

FIG. 3F also illustrates railcar cover system 200 configured in an open position in accordance with particular embodiments. From the closed position illustrated in FIG. 2, outer structural members 250 move along tracks 215*b* from a position near top chords 216 toward the middle railcar 210 in the direction of arrows 292. As this movement occurs, cover portions 216 fold in on themselves, so as to open the railcar cover system. As illustrated in FIG. 2, the two halves of system 200 overlap slightly in the middle. Therefore, in some embodiments, inner structural members 240 may move a short distance away from the middle of railcar 210 in the direction of arrows 290. This positioning of inner structural members 240 causes cover portions 260 to hang below inner structural members 240 and outer structural members 250 downward into railcar 210, generally below top chords 216.

Similar to the configuration described in conjunction with FIGS. 3C and 3D, positioning railcar cover system 200 in this manner, allows the side portions of railcar 210 to remain unobstructed, which may better facilitate loading and unloading of the railcar for transport. For example, as described previously, in various embodiments used in conjunction with rail transport, rotary dumping may be employed. Positioning railcar cover system 200 in an open configuration as illustrated in FIG. 3F may allow coal to be more easily unloaded by a rotary dumper or other mechanism that unloads coal by partially or fully overturning a railcar. In some embodiments, cover portions may not extend into railcar 210 or may extend to any suitable length in the railcar.

Conventional railcar covers often include two halves that each pivot on the top chord of the long side of a railcar. Conventional covers may also include a "clam" type cover that obstructs the long side of a railcar and various solid fiberglass one piece and two piece covers that similarly obstruct one or both of the long sides of a railcar. Railcars are increasingly unloaded using rotary dumpers. Rotary dumpers may utilize clamps to grasp a railcar along the long side top chord before partially or fully overturning the car. Rotary dumpers may also use machinery that abuts a long side of a railcar before similarly partially or fully overturning the car. Thus, these conventional railcar covers with components that obstruct the long side wall may impede or prevent the use of rotary dumpers. Various embodiments of the present disclosure may overcome the challenge of leaving the long sides of railcars unencumbered, thus making rotary dumping both possible and easier.

Other conventional railcar covers rely on a covering system that may not impede rotary dumping by utilizing a cover that does not need to be removed prior to unloading. These railcar covers utilize a slatted cover, with slats that can pivot open when a railcar is turned partially or completely over during a rotary dump. Certain embodiments may also improve upon this design by eliminating any slats or other small exit openings that may obstruct the path of exiting materials and prevent large items, like solid or frozen chunks, from successfully exiting the car.

Various embodiments further improve upon conventional covers by significantly reducing the weight associated with fiberglass or other solid covers. Rail operators may not exceed established weight limits on tracks. Therefore, clam like and other solid covers may constitute a significant weight penalty that the present embodiments may avoid.

Figure 4A:
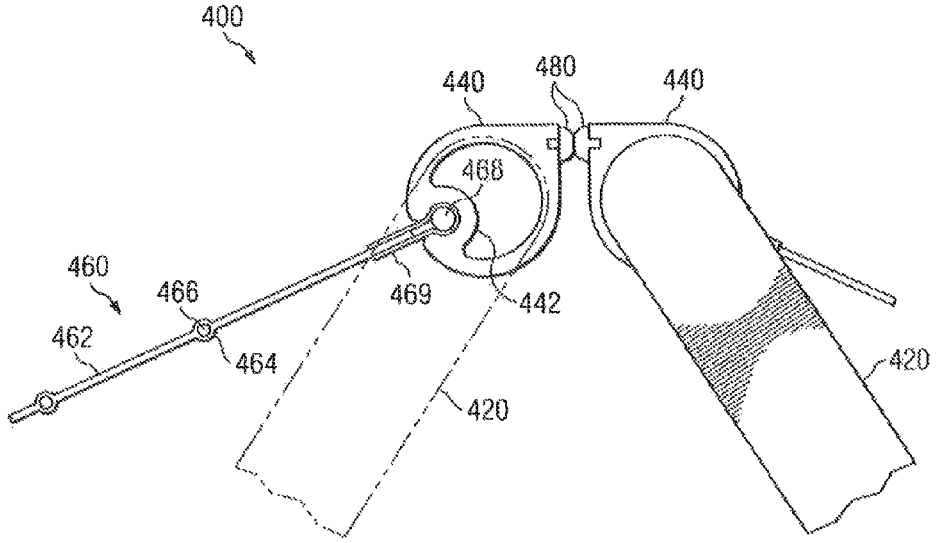
FIGS. 4A and 4B illustrate a portion of a railcar cover system in accordance with particular embodiments.
Figure 4B:
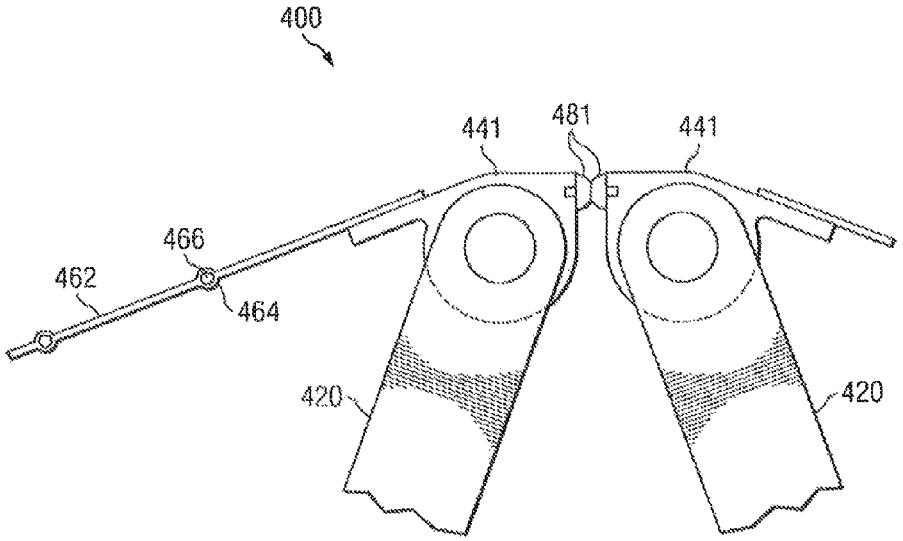

FIGS. 4A and 4B illustrate a portion of a railcar cover system in accordance with particular embodiments. FIGS. 4A and 4B illustrate a railcar cover system 400 comprising inner levers 420, inner structural members 440, cover portions 460, and cover stoppers 480. Cover portion 460 comprises fabric portion 462, slots 464, and rod portions 466. As illustrated in FIG. 4A, inner structural member 440 comprises track portion 442 and cover portion 460 additionally comprises hinge pin 468 and reinforcing portion 469.

Cover portion 460 includes slots 464 within fabric portion 462 configured such that rods 466 may run inside them. Slots 464 run generally parallel to inner structural members 420, which are similar to the inner structural members described in conjunction with FIGS. 1A and 1B. Slots 464 are spaced at generally equal intervals, approximately eight to ten inches apart. Rod portions 466 comprise a nylon rod, approximately three-eighths of an inch in diameter. In various embodiments, slots suitable for rod portions may occur at closer, farther, or irregular intervals. Utilizing one or more rod portions may reduce fluttering of the fabric portion during rail transit.

In certain embodiments, the rod portion will comprise one continuous nylon rod that stretches the length of the railcar cover. In various embodiments, the rod portion may comprise several individual rods abutting each other within a rod slot. Further, in various embodiments the fabric portion may contain empty rod slots, as rods need not be inserted for some railcar cover systems to function. In certain embodiments of the railcar cover system that utilize an end section similar to that illustrated in FIG. 7, the cover portions may comprise rod portions only in the fabric portion of the railcar cover that runs generally parallel to the long side of the railcar and not in the fabric portion of the cover that bends inward toward the inner structural members, or the cover portions may comprise rod portions throughout.

In various embodiments, rod portions may taper near the end of the railcar cover or in any suitable place. In certain embodiments, the rod portion may have a diameter greater or smaller than three-eighths of an inch, or a diameter of any suitable measurement. In particular embodiments, the rod portion may be plastic, metal, a natural material (e.g. bamboo or cane), or any suitable material. In certain embodiments, the fabric portion may comprise a slot within the material of the fabric portion or the rod portion may be fastened to the exterior of the fabric portion. In particular embodiments, rod portions may be fastened to the fabric portion facing the interior of the railcar or the side facing the exterior environment. In certain embodiments, the fabric portion may itself comprise hardened sections, similarly sized and spaced to the illustrated exemplary rod portions, thus making the addition of a rod portion unnecessary.

In various embodiments, the fabric portion of the railcar cover may comprise a single layer or multiple layers of material. Each layer of a multi-layered fabric may provide unique or advantageous properties. For example, a top layer may be water proof or water resistant, while a bottom layer may resist dust collection. Alternately, a single layer cover may have unique functionalities on each side due to its construction or treatment. In particular embodiments, the cover portions may comprise ballistic nylon, ballistic nylon with a neoprene coating, ballistic nylon with a hypalon coating or chlorosulphonated polyethylene (CSM) coating, any hypalon, neoprene, or CSM coated fabric, any suitable fabric, or any suitable non-fabric material. The fabric selected in various embodiments may be fully or partially resistant to water, abrasion, high temperatures, oxidation, ozone, sunlight, fire, chemicals (e.g., acids, oils, or greases), dust, or some combination of all or some of these characteristics. In certain embodiments, the fabric portion of a cover may be one continuous piece of fabric. In various embodiments, the fabric portion may be multiple pieces of fabric fastened together. And in particular embodiments, the fabric portion may be composite strips fastened together at the location of a rod portion or in any suitable location.

In the embodiment illustrated in FIG. 4*a*, track portion 442 of inner structural member 420 is c-shaped, which may facilitate coupling of the cover portion 460 and structural member 440 by allowing the insertion of hinge pin 468 into track portion 442. Reinforcing portion 469 is fastened to the edge of cover portion 460 and may strengthen the coupling point. In particular embodiments, the reinforcing portion may extend a greater or lesser distance from the hinge pin portion onto the fabric portion. In various embodiments, the fabric portion may surround the hinge pin portion without a reinforcing portion. Coupling the cover portion to the structural member by using a hinge pin and track portion may provide a lower-weight solution than other means of coupling, fastening, or affixing the cover. In certain embodiments, a track portion of a structural member may be t-shaped, rectangular-shaped or any suitable shape, and a hinge pin portion may be t-shaped, rectangular-shaped, or any suitable shape. In various embodiments, a structural member comprising a track portion may be otherwise solid, hollow, or of any suitable density. In various embodiments, both inner and outer structural members will comprise track portions suitable for coupling a cover portion.

In certain embodiments, cover portions may be coupled to inner and outer structural member in an suitable way. For example, as illustrated in FIG. 4*b*, cover portions 460 are fastened to inner structural members 440 such that cover portions 460 overlap an upper portions of each structural member 440. In various embodiments, any suitable fastener or adhesive or both may be used to attach cover portions to structural members.

In the illustrated embodiments, cover stoppers 480 are affixed to inner structural members 420. When inner structural members 420 are positioned above the interior of the railcar such that the cover is in a closed position or in an open position suitable for unloading, cover stoppers 480 may make contact with each other. Cover stoppers may comprise rubber or any suitable material. In various embodiments, structural members or cover stoppers may comprise an attachment mechanism that allows the two inner structural members to remain attached during transit or at other suitable times. Cover stoppers may help protect inner structural members from damage incurred during transit, unloading, or the opening and closing of the inner structural members, which require configurations similar to those described in conjunction with FIGS. 1, 2, 3*a*, and 3*b*. As the contact point between inner structural members in some embodiments, cover stoppers may bear any associated wear and tear and may be more easily removed and replaced than inner structural members.

In embodiments utilizing the configuration disclosed in conjunction with FIG. 2, the cover portions may be similarly attached to the inner and outer structural members. For example, in some embodiments, a cover portion may be coupled to a cable inner structural member as illustrated in FIG. 4A or 4B. In various embodiments, a cover portion be coupled to a structural member by including a fabric slot at the edge of the cover portion through which a cable inner structural member may be pulled. Additionally or alternately, the cable may be sewn into place in various embodiments.

Figure 5:
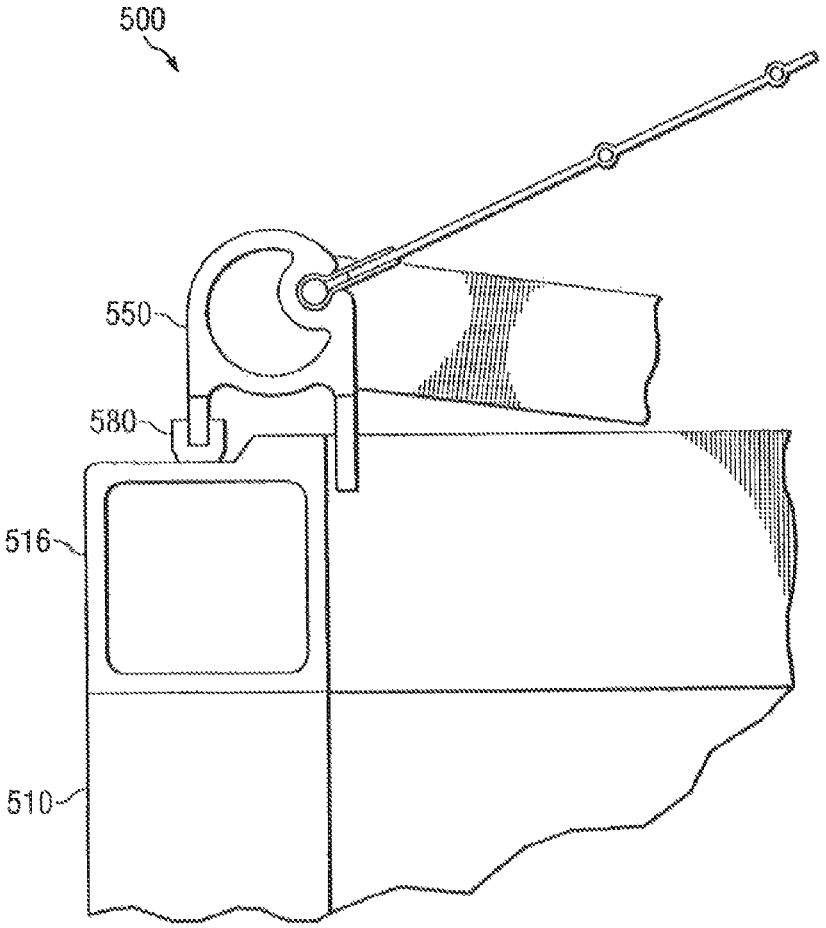
FIG. 5 illustrates a contact point in a railcar cover system in accordance with particular embodiments.

FIG. 5 illustrates a contact point in a railcar cover system in accordance with particular embodiments. Railcar cover system 500 comprises railcar 510, top chord 516, outer structural member 550, and gasket 580. Particular embodiments may utilize none, one, two, or any suitable number of gaskets, spaced regularly or irregularly down the length of structural member 550. In certain embodiments, gaskets may comprise rubber or any suitable material. Utilizing gaskets may assist in preventing damage to an outer structure member when it is touching or near the top chord of a railcar.

Figure 6:
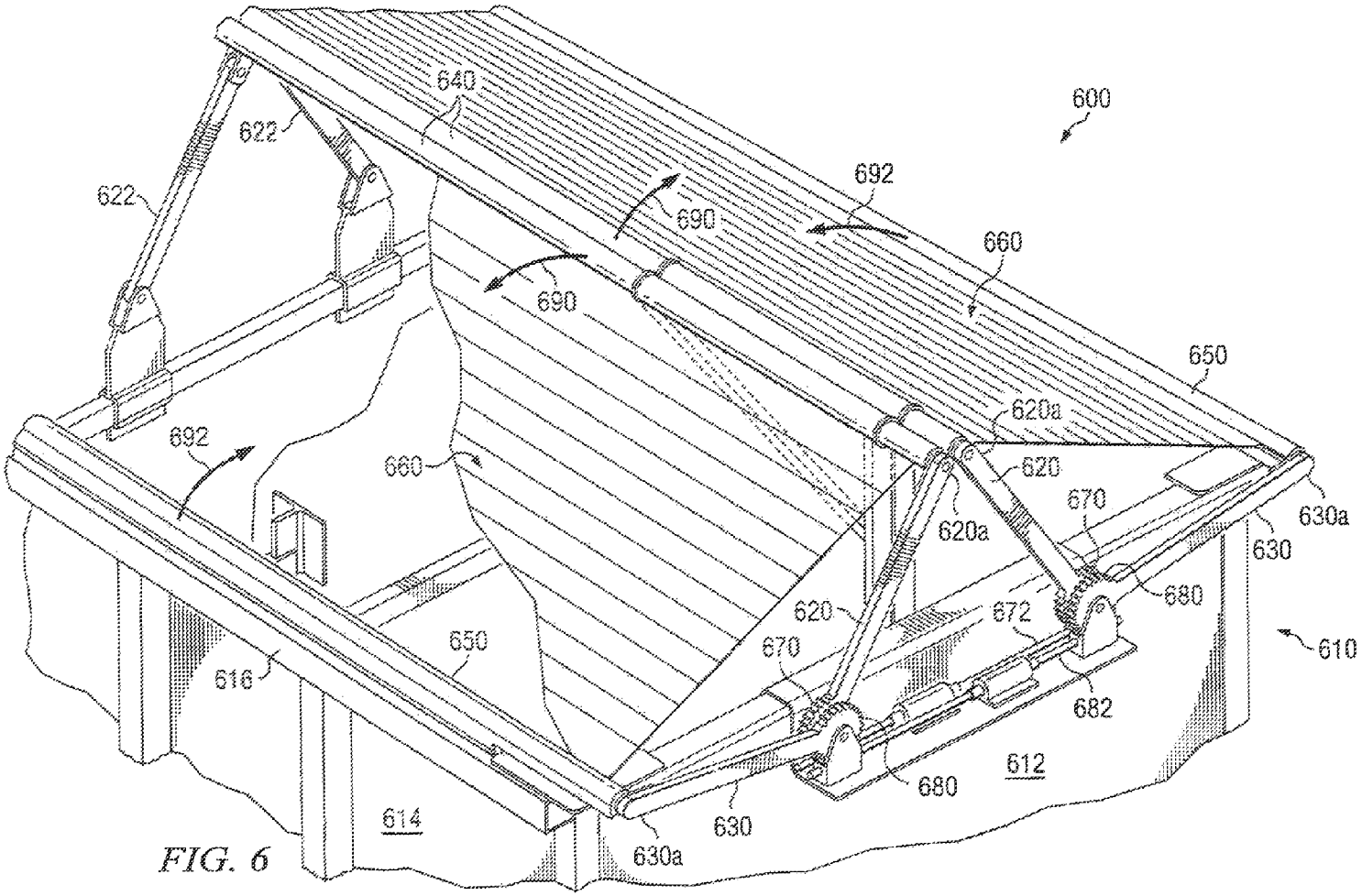
FIG. 6 illustrates a mechanism for opening and closing a railcar cover system in accordance with particular embodiments.

FIG. 6 illustrates a mechanism for opening and closing a railcar cover system in accordance with particular embodiments. Railcar cover system 600 comprises railcar 610, interior inner levers 622, inner structural members 640, outer structural members 650, cover portions 660, inner pivoting nuts 670, inner acme threaded rod 672, outer pivoting nuts 680, and outer acme threaded rod 682. Inner and outer pivoting nuts 670 and 680 comprise inner levers 620 with ends 620*a* and outer levers 630 with ends 630*a*, respectively. Rail car 610 comprises short sides 612, long sides 614, and top chord 616. Also illustrated are directional arrows 690 and 692.

In the illustrated embodiment, inner levers 620 and outer levers 630 are configured such that cover portions 660 create a canopy over railcar 610, similar to the cover portions described in conjunction with FIGS. 1 and 2. Rotating acme threaded rod 682 will cause rotation of outer pivoting nuts 680, which will result in movement of outer levers 630. More specifically, it will result in the movement of ends 630*a* and structural members 650 in the respective directions of arrows 692, such that cover portions 460 would be in an open position suitable for unloading, similar to the cover portions described in conjunction with FIG. 3*b*.

Similarly, rotating acme threaded rod 672 will cause rotation of inner pivoting nuts 670, which will result in movement of inner levers 620. More specifically, it will result in the movement of ends 620*a* and structural members 640 in the respective directions of arrows 690 toward top chord 616, such that cover portion 660 would be in an open position suitable for loading, similar to the cover portions described in conjunction with FIG. 3*a*.

Interior inner levers 622 provide support for inner structural members 640 during this movement. The configuration and position of interior inner levers 622 ensure that the railcar's interior center section remains clear for unloading and ensure that the interior side sections remain clear for unloading. In certain embodiments, there may be no interior levers, one pair, multiple pairs, or multiple un-paired levers configured in any suitable manner inside a railcar. In embodiments with interior levers, they may support inner structural members, outer structural members, or both. In various embodiments, interior inner levers may have an independent movement mechanism to facilitate movement, while in particular embodiments, interior inner levers may rely on a movement mechanism or movement mechanisms associated with other system levers for directional movement.

Various embodiments may utilize a worm drive or any suitable gear mechanism to move inner levers 620 and outer levers 630. Various embodiments may include these components at one or both short sides of railcar. In particular embodiments, the railcar cover system will powered by electric, pneumatic, or hydraulic power, any combination of these power sources, or any available power source. A worm drive, or any suitable mechanism to move inner levers SS and outer levers SS, may allow a railcar cover system to be opened and closed without manual assistance. This may permit a railcar cover system to be operated remotely or automatically or both, which may serve to facilitate easier or less-labor intensive unloading and loading. In certain embodiments, a movement mechanism and other components of a railcar system may be configured such that they can be easily used by any existing railcar. This may occur, for example by coupling all components of the system to two shelf-like components that could rest or attach to opposing top chords.

Figure 7:
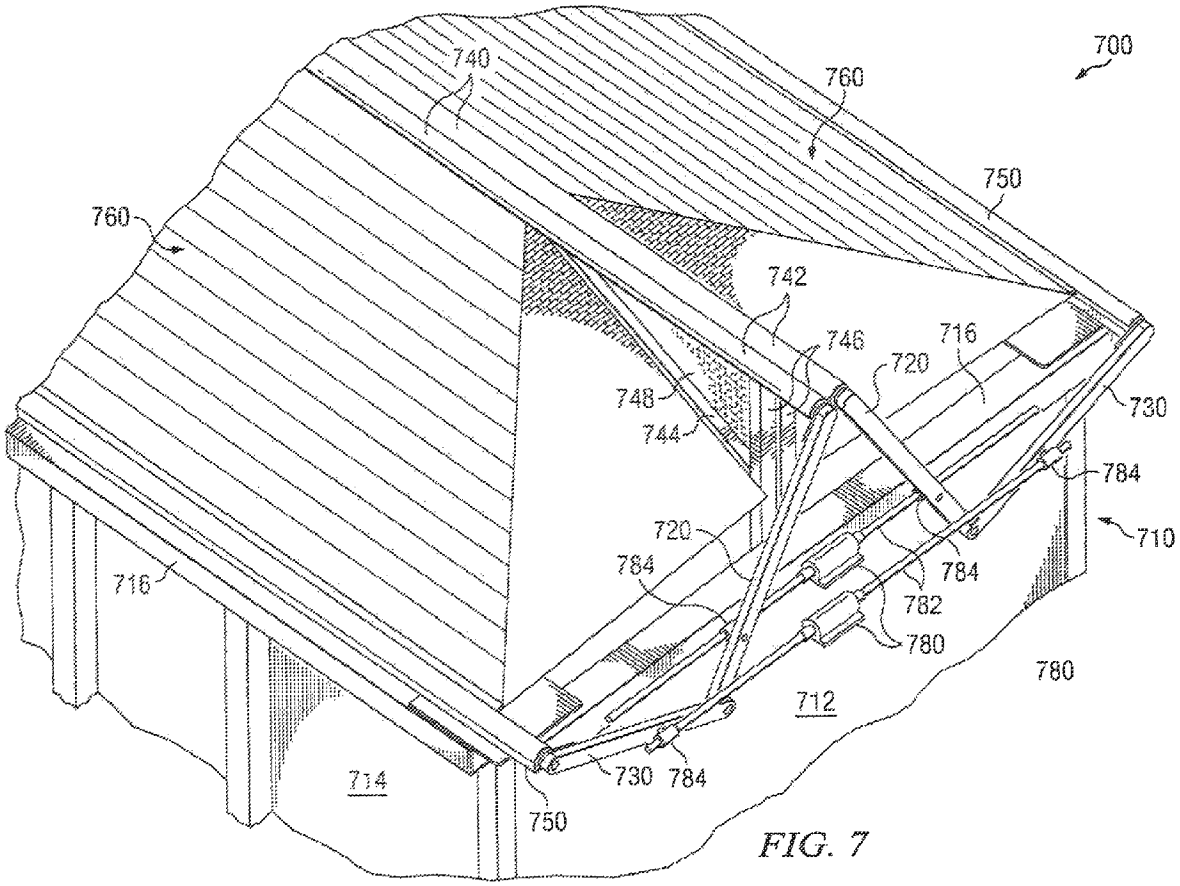
FIG. 7 illustrates a perspective view of a railcar cover system in accordance with particular embodiments.

FIG. 7 illustrates a perspective view of a railcar cover system in accordance with particular embodiments. Railcar cover system 700 comprises railcar 710, inner levers 720, outer levers 730, inner structural members 740, outer structural members 750, and cover portions 760. Inner structural members 740 comprise top portions 742, angular portions 744, perpendicular portions 746, and barrier portions 748. Railcar 710 comprises short sides 712, long sides 714, and top chord 716. Also illustrated are drive components 780, threaded rods 782, and coupling nuts 784.

Coupling nuts 784 are coupled to inner levers 730 and outer levers 740 respectively. Rotation of threaded rods 782 by drive components 780 will cause coupling nuts 784 to move along threaded rods 782. Thus, when threaded rods 782 are rotated such that coupling nuts 784 move, inner and outer levers 730 and 740 may be positioned so as to allow for transport, loading, and unloading, similar to the embodiments discussed in conjunction with FIGS. 1, 2, 3*a*, and 3*b*. In various embodiments, drive components 780 may be operated such that inner levers and outer levers are moved simultaneously or independently and may be powered by any suitable source. Drive components 780, threaded rods 782, and coupling nuts 784 provide an alternative movement mechanism to the mechanism described in conjunction with FIG. 6. In various embodiments, other suitable movement mechanisms may be utilized.

Top portions 742 of inner structural members 740 extend generally parallel to long sides 714 of railcar 710, generally above the longitudinal center of the railcar. Angular portions 744 create acute angles with top portions 742 as they extend toward a short side 712 of railcar 710. Perpendicular portions 746 create approximate right angles with top portions 742 as they extend toward the interior of railcar 710. A top portion, angular portion, and perpendicular portion combine to create a triangular shape near each end of an inner structural member. Within this triangular section, barrier portions 748 are coupled to the top, angular, and perpendicular portions. In particular embodiments, structural member portions may be configured to create any suitable shape. Various embodiments may employ inner structural members with the top, angular, and perpendicular portion configuration near one of both short ends of the railcar. In certain embodiments, the angular and perpendicular portions may be located at any suitable location along the top portion. Various embodiments will employ a barrier portion comprising fabric, plastic, metal, any suitable material, or any combination of these materials. In certain embodiments, the structural members may comprise aluminum composite material, metal, plastic, resin, a composite material, or any suitable material. In various embodiments, barrier portions may improve the structural integrity of the railcar cover system. Embodiments that utilize the barrier portion configuration may allow for additional flexibility in configuring cover portions and may improve the aerodynamic properties of the railcar cover system during transport.

Cover portions 760 extend between inner structural members 740 and outer structural members 750. Each cover portion is coupled to an inner structural member 760 along angular portion 744 such that the cover portion bends inward near each short side 412 of railcar 710. This configuration allows cover portions 760 to create a canopy that more fully encloses railcar 710. Providing a railcar cover that more effectively creates a covering canopy over the entire interior of the railcar, including over the portions at an end or ends of the car, may reduce dust deposits outside the railcar during transport. In addition, this configuration may improve the aerodynamics of loaded railcars during transport and may also improve the aerodynamics of unloaded cars during transport by reducing the drag associated with empty railcars.

Figure 8:
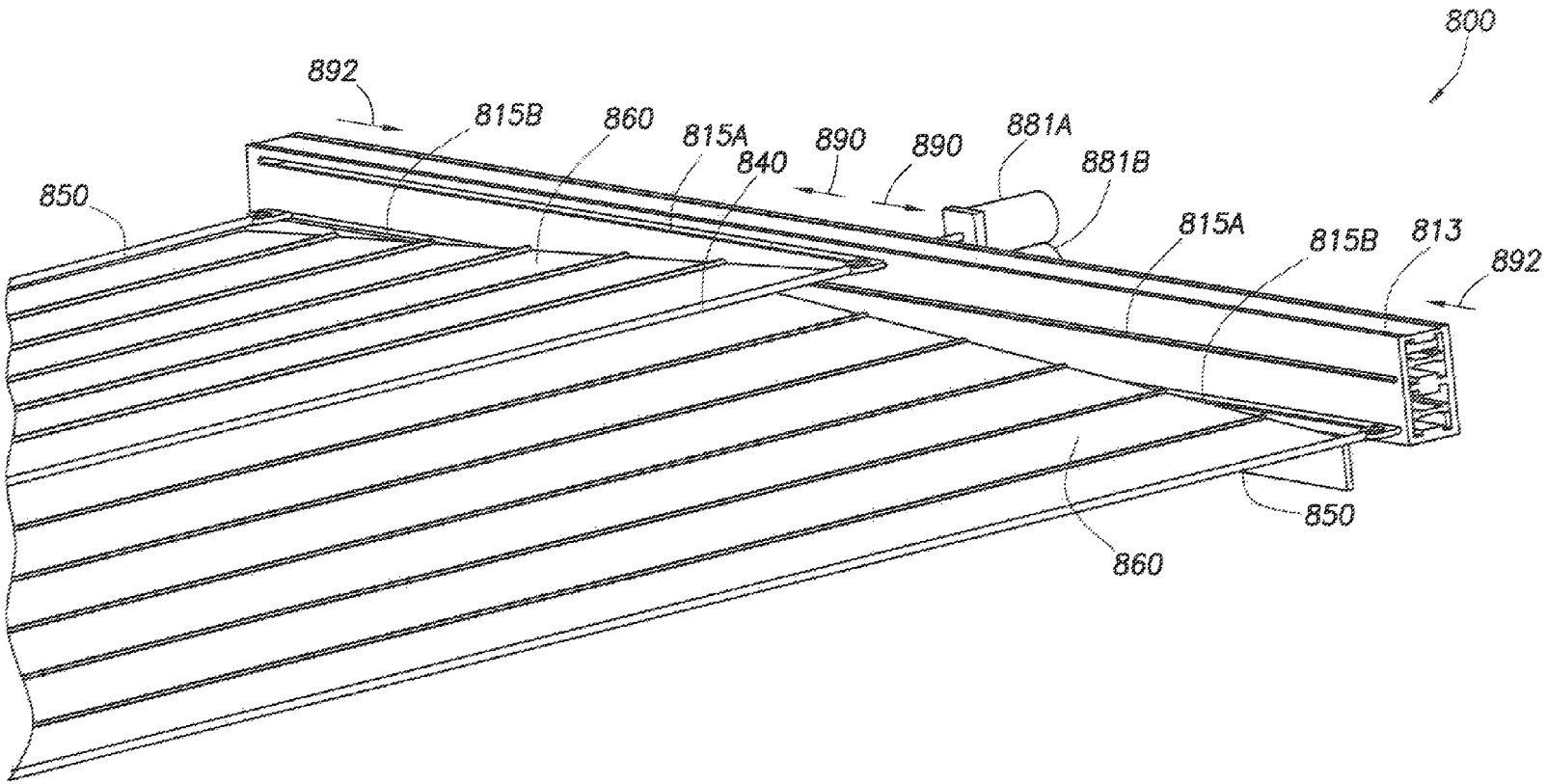
FIG. 8 illustrates another mechanism for opening and closing a railcar cover system in accordance with particular embodiments.

FIG. 8 illustrates another mechanism for opening and closing a railcar cover system in accordance with particular embodiments. Railcar cover system 800 comprises insert 813 with tracks 815, inner structural members 840, outer structural members 850, cover portions 860, and drive motors 881. Also illustrated are direction arrows 890 and 892.

In the illustrated embodiment, insert 813 is configured to be coupled to a railcar (not illustrated). Cover portions 860 extend between inner structural members 840 and outer structural members 850 to create a canopy, which may be used to cover goods, such as coal, during transport in a railcar. Activating drive motor 881*a* will move inner structural members 840 in tracks 815*a* toward the ends of insert 813 in the direction of arrows 890. Using drive motor 881*a* to move inner structural members 840 may allow system 800 to be configured in an open position, including, for example, positions similar to the positions described in conjunction with FIGS. 3E and 3F. Activating drive motor 881*b* will more outer structural members 850 in tracks 815*b* toward the middle of insert 813 in the direction of arrows 892. Using drive motor 881*b* to move outer structural members 850 may allow system 800 to be configured in an open position, including for example, a position similar to the position described in conjunction with FIG. 3F. In particular embodiments, a single mechanism may control all structural members. In other embodiments, each structural member may be controlled by a corresponding mechanism.

In various embodiments, any suitable drive mechanism may be used to move inner structural members 840 and outer structural members 850 in tracks 815 so as to open or close system 800. For example, various mechanical devices may be used. In certain embodiments, a mechanism may rely on any suitable power source, including, for example, electric, pneumatic, or hydraulic power sources.

Certain embodiments of system 800 may include a single cover portion that extends between two structural members across approximately the entirety of a railcar. In these embodiments, a drive mechanism may move either structural member to any point along a track or tracks that span the entire width of a railcar.

Figure 9A:
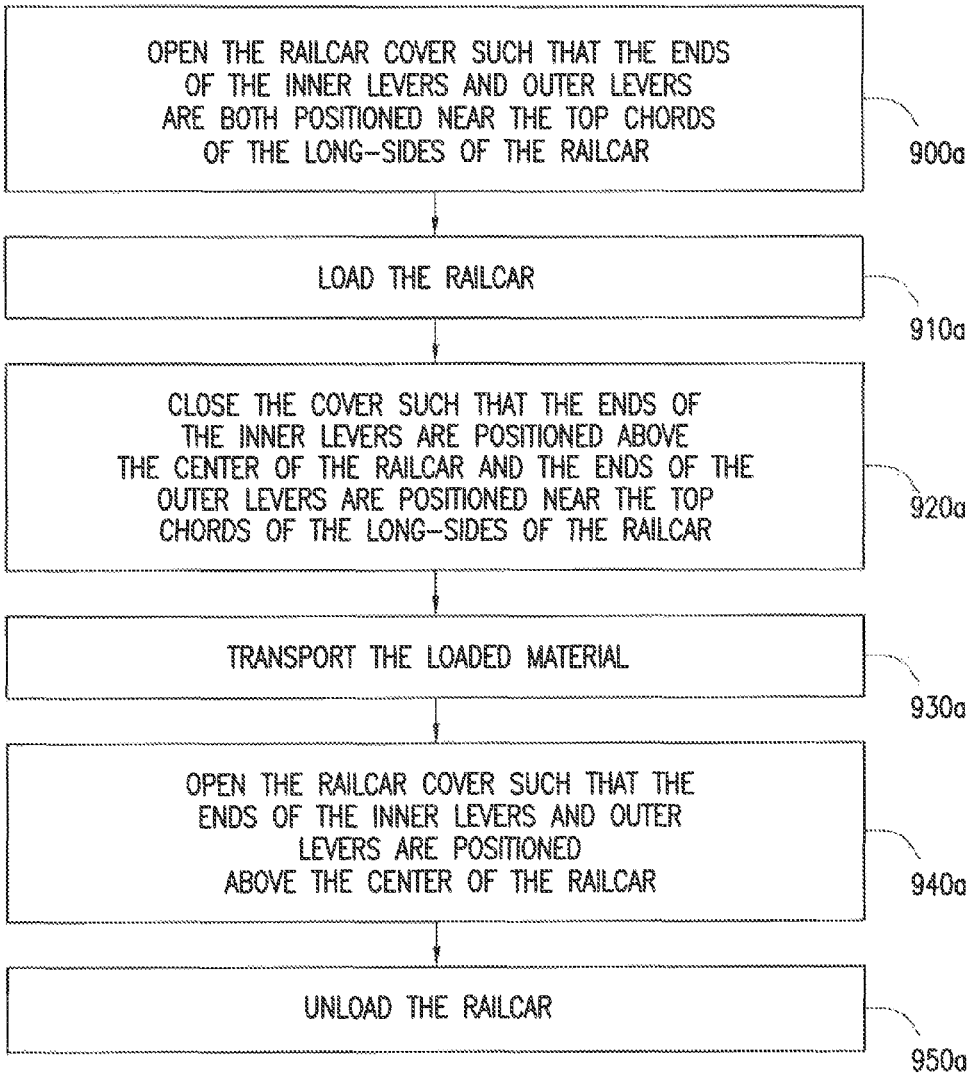
FIGS. 9A and 9B are flow charts illustrating methods for using railcar cover systems in accordance with particular embodiments.

FIG. 9A is a flow chart illustrating a method for using a railcar cover system in accordance with particular embodiments. The method begins at step 900*a* where the railcar cover system is opened, such that the ends of the inner and outer levers are both positioned near the top chords of the long sides of the railcar, similar to the position described in conjunction with FIG. 3A. At step 910*a*, the railcar is loaded. The loading may occur through any suitable means, for example by using a coal tipple to load coal into the railcar.

At step 920*a*, the railcar cover is closed such that the ends of the inner levers are positioned above the center of the rail car and the ends of the exterior levers are positioned near the top chords of the long side of the rail car, similar to the configurations illustrated in FIGS. 1A and 1B. At step 930*a*, the loaded railcar travels to a destination, transporting the contents of the car.

At step 940*a*, the railcar cover is opened such that the ends of the inner levers and outer levers are position above the center of the railcar, similar to the configuration described in conjunction with FIG. 3B. At step 950*a*, the railcar is unloaded. Unloading may occur, for example, by using a rotary dumper to tip and empty the railcar.

Figure 9B:
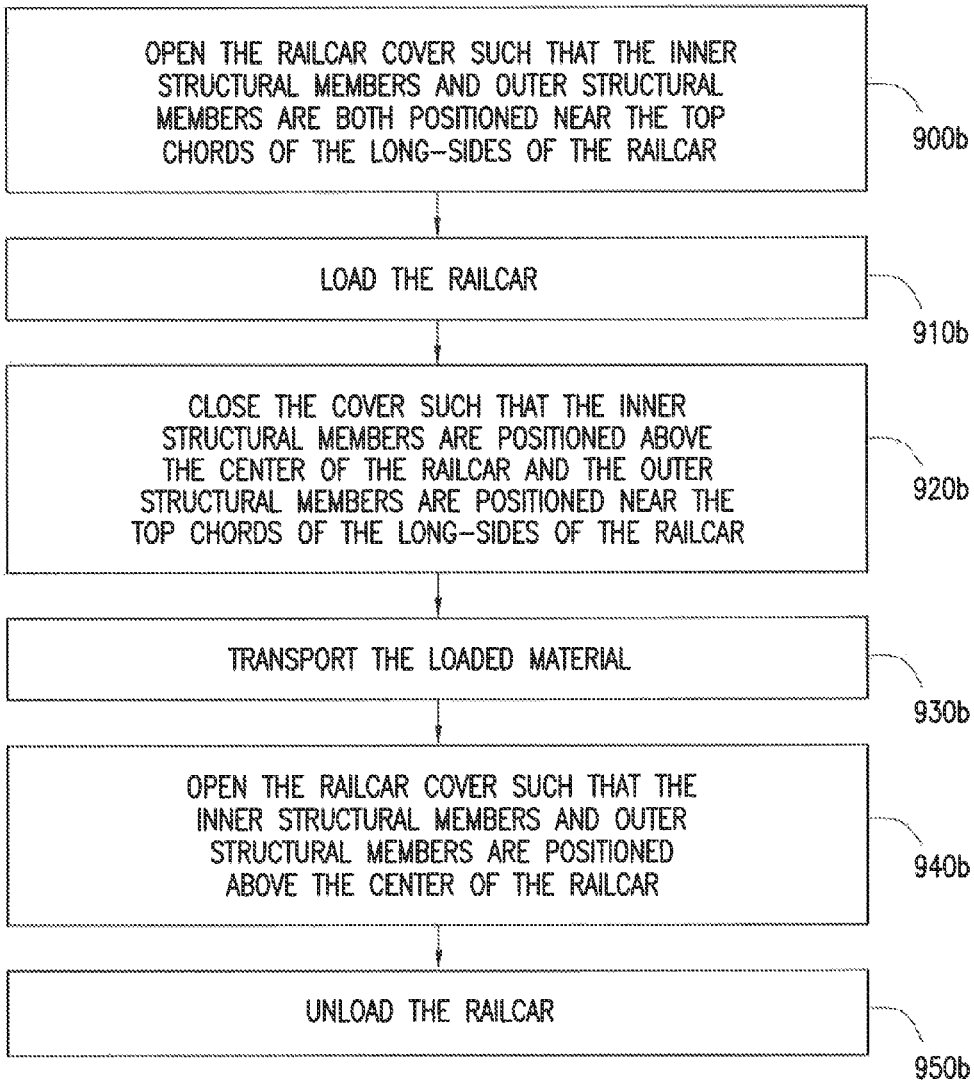

FIG. 9B is a flow chart illustrating another method for using a railcar cover system in accordance with particular embodiments. The method begins at step 900*b* where the railcar cover system is opened, such that the inner structural members and outer structural members are both positioned near the top chords of the long sides of the railcar, similar to the position described in conjunction with FIG. 3E. In various embodiments, this may occur by moving inner structural members along tracks located in inserts at the short ends of a railcar. In particular embodiments, inner structural members may be cables that run between these inserts. Cover portions may be coupled to the cable inner structural members.

At step 910*b*, the railcar is loaded. The loading may occur through any suitable means, for example by using a coal tipple to load coal into the railcar.

At step 920*b*, the railcar cover is closed such that the inner structural members are positioned above the center of the rail car and the outer structural members are positioned near the top chords of the long side of the rail car, similar to the configurations illustrated in FIGS. 1A and 1B.

At step 930*a*, the loaded railcar travels to a destination, transporting the contents of the car.

At step 940*a*, the railcar cover is opened such that the ends of the inner levers and outer levers are position above the center of the railcar, similar to the configuration described in conjunction with FIG. 3F. In various embodiments, this may occur by moving outer structural members along tracks located in inserts at the short ends of a railcar. In particular embodiments, outer structural members may be cables that run between these inserts. Cover portions may be coupled to the cable outer structural members. In various embodiments, inner structural members may also be moved as described in conjunction with FIG. 3F.

At step 950*b*, the railcar is unloaded. Unloading may occur, for example, by using a rotary dumper to tip and empty the railcar.

Some of the steps illustrated in FIGS. 9A and 9B may be combined, modified, or deleted where appropriate, and additional steps may also be performed in any suitable order without departing from the scope of the invention.

Although the present invention has been described in detail with reference to particular embodiments, it should be understood that various other changes, substitutions, and alterations may be made hereto without departing from the spirit and scope of the present invention. For example, although particular embodiments of the disclosure have been described with reference to a number of elements included in a railcar cover, these elements may be combined, rearranged or positioned in order to accommodate particular covering requirements or needs. Various embodiments contemplate great flexibility in the railcar cover and its components. Additionally, while some embodiments are described with respect to a railcar cover, particular embodiments may be used cover any open-topped transport container.

What is claimed is:

1. A system for covering a railcar, comprising:

a first set of structural members coupled to a railcar and a second set of structural members coupled to the railcar, the first set and second set of structural members configured to move between a loading position, an unloading positing, and a covered position; and a plurality of cover portions, each cover portion of the plurality of cover portions coupled to a structural member of the first set of structural members and a structural member of the second set of structural members;

wherein, in the loading position, at least one of the first set and at least one of second set of structural members are proximate longitudinal sides of the railcar;

wherein, in the unloading position, at least one of the first set and at least one of second set of structural members are proximate a longitudinal center line of the railcar; and wherein, in the covered position, the first set of structural members are proximate the longitudinal center line of the railcar and the second set of structural members are proximate the longitudinal sides of the railcar.

2. The system of claim 1, wherein the plurality of cover portions comprise a fabric material.

3. The system of claim 1, wherein:

in the loading position and the unloading position, the plurality of cover portions fold downward into the railcar; and in the covered position, the plurality of cover portions extend between the first set and second set of structural members.

4. The system of claim 1, wherein the first set of structural members are coupled to the railcar through a first set of levers, and the second set of structural members are coupled to the railcar through a second set of levers.

5. The system of claim 1, further comprising a mechanism operable to move one or more of the structural members of the first or second set of structural members.

6. The system of claim 1, wherein the first set and second set of structural members are coupled to an insert that is operable to be removed from the railcar.

7. A method for opening a railcar cover comprising:

moving, between a covered position and a loading position, a first set of structural members coupled to a railcar and a second set of structural members coupled to the railcar;

the railcar cover comprising a plurality of cover portions, each cover portion of the plurality of cover portions coupled to a structural member of the first set of structural members and a structural member of the second set of structural members;

wherein, in the loading position, at least one of the first set and at least one of second set of structural members are proximate longitudinal sides of the railcar; and wherein, in the covered position, the first set of structural members are proximate a longitudinal center line of the railcar and the second set of structural members are proximate the longitudinal sides of the railcar.

8. The method of claim 7, wherein the plurality of cover portions comprise a fabric material.

9. The method of claim 7, wherein:

in the loading position, the plurality of cover portions fold downward into the railcar; and in the covered position, the plurality of cover portions extend between the first set and second set of structural members.

10. The method of claim 7:

wherein the first set of structural members are coupled to the railcar through a first set of levers and the second set of structural members are coupled to the railcar through a second set of levers; and wherein moving between a covered position and a loading position comprises moving the first set of levers so as to cause the first set of structural members to move.

11. The method of claim 7, further comprising activating a mechanism to initiate movement of the first set of structural members, the second set of structural members, and the plurality of cover portions.

12. The method of claim 7, wherein the first set of structural members and the second set of structural members are coupled to an insert that is operable to be removed from the railcar.

13. A method for opening a railcar cover comprising:

moving, between a covered position and an unloading position, a first set of structural members coupled to a railcar and a second set of structural members coupled to the railcar;

the railcar cover comprising a plurality of cover portions, each cover portion of the plurality of cover portions coupled to a structural member of the first set of structural members and a structural member of the second set of structural members;

wherein in the unloading position, at least one of the first set and at least one of second set of structural members are proximate a longitudinal center line of the railcar; and wherein in the covered position, the first set of structural members are proximate the longitudinal center line of the railcar and the second set of structural members are proximate longitudinal sides of the railcar.

14. The method of claim 13, wherein the plurality of cover portions comprise a fabric material.

15. The method of claim 13 wherein:

in the unloading position, the plurality of cover portions fold downward into the railcar; and in the covered position, the plurality of cover portions extend between the first set and second set of structural members.

16. The method of claim 13:

wherein the first set of structural members are coupled to the railcar through a first set of levers and the second set of structural members are coupled to the railcar through a second set of levers; and wherein moving between a covered position and an unloading position comprises moving the second set of levers so as to cause the second set of structural members to move.

17. The method of claim 13, further comprising activating a mechanism to initiate movement of the first set of structural members, the second set of structural members, and the plurality of cover portions.

* * * * *